US006003963A

United States Patent [19]

Grender

[11] Patent Number: 6,003,963

[45] Date of Patent: Dec. 21, 1999

[54] COMBINATION TABLE AND DESK

[76] Inventor: Elizabeth J. Grender, "Coombe Vane"Warren Rise, New Malden, United Kingdom, KT3 4SJ

[21] Appl. No.: 09/078,633

[22] Filed: May 14, 1998

[51] Int. Cl.[6] ..... A47B 17/04

[52] U.S. Cl. ..... 312/204; 312/291; 108/25; 108/90; 108/167

[58] Field of Search ..... 108/25, 26, 90, 108/67, 166, 167, 176, 150, 157.17, 38; 312/204, 194, 195, 291, 297, 21, 290, 327, 328, 140.1, 140.2, 140.3, 140.4

[56] References Cited

U.S. PATENT DOCUMENTS

| | | | |
|---|---|---|---|
| 224,302 | 2/1880 | Morrison | 108/26 |
| 236,588 | 1/1881 | Hoffmeier | 312/233 X |
| 676,127 | 6/1901 | Fox | 312/290 |
| 776,355 | 11/1904 | Selander | 108/25 X |
| 1,427,957 | 9/1922 | Hobart | 312/194 X |
| 1,694,283 | 12/1928 | Reid | 312/291 X |
| 1,904,897 | 4/1933 | Kahrs | 108/90 |
| 2,556,943 | 6/1951 | Reisman | 108/90 |
| 2,683,639 | 7/1954 | Brenny | 108/34 X |
| 3,583,782 | 6/1971 | Ball | 312/290 |
| 4,538,861 | 9/1985 | Hughes, Jr. | 190/10 X |

*Primary Examiner*—Janet M. Wilkens

[57] ABSTRACT

A new combination table and desk for combining functions of a desk and a table. The inventive device includes a base portion having a desktop disposed thereon. The desktop has a generally rectangular configuration. The desktop has a pair of storage containers. A table top portion is coupled with an upper surface of the desktop. The table top portion includes a plurality of sections hingedly coupled together at side edges thereof. The plurality of sections fold one over another to expose the desktop.

6 Claims, 2 Drawing Sheets

COMBINATION TABLE AND DESK

BACKGROUND OF THE INVENTION

1. Field of the Invention

The present invention relates to portable furniture and more particularly pertains to a new combination table and desk for combining functions of a desk and a table.

2. Description of the Prior Art

The use of portable furniture is known in the prior art. More specifically, portable furniture heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable furniture include U.S. Pat. No. 4,919,498 to Turner; U.S. Pat. No. 4,966,258 to Hawley; U.S. Pat. No. 4,790,416 to Baker; U.S. Pat. No. 5,368,377 to Baines; U.S. Pat. No. 5,054,776 to Wyman; and U.S. Pat. No. Des. 290,560 to Carrabba.

While these devices fulfill their respective, particular objectives and requirements, the aforementioned patents do not disclose a new combination table and desk. The inventive device includes a base portion having a desktop disposed thereon. The desktop has a generally rectangular configuration. The desktop has a pair of storage containers. A table top portion is coupled with an upper surface of the desktop. The table top portion includes a plurality of sections hingedly coupled together at side edges thereof. The plurality of sections fold one over another to expose the desktop.

In these respects, the combination table and desk according to the present invention substantially departs from the conventional concepts and designs of the prior art, and in so doing provides an apparatus primarily developed for the purpose of combining functions of a desk and a table.

SUMMARY OF THE INVENTION

In view of the foregoing disadvantages inherent in the known types of portable furniture now present in the prior art, the present invention provides a new combination table and desk construction wherein the same can be utilized for combining functions of a desk and a table.

The general purpose of the present invention, which will be described subsequently in greater detail, is to provide a new combination table and desk apparatus and method which has many of the advantages of the portable furniture mentioned heretofore and many novel features that result in a new combination table and desk which is not anticipated, rendered obvious, suggested, or even implied by any of the prior art portable furniture, either alone or in any combination thereof.

To attain this, the present invention generally comprises a base portion including four legs extending downwardly from a desktop. The desktop has a generally rectangular configuration. The desktop has a pair of storage containers secured to a lower surface thereof. The desktop has a pair of openings therethrough leading into the storage containers. The pair of openings each have a cover member hingedly secured thereto. The cover members each have a recessed handle. A table top portion is coupled with an upper surface of the desktop. The table top portion includes a plurality of sections hingedly coupled together at side edges thereof. The plurality of sections fold one over another to expose the desktop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination table and desk apparatus and method which has many of the advantages of the portable furniture mentioned heretofore and many novel features that result in a new combination table and desk which is not anticipated, rendered obvious, suggested, or even implied by any of the prior art portable furniture, either alone or in any combination thereof.

It is another object of the present invention to provide a new combination table and desk which may be easily and efficiently manufactured and marketed.

It is a further object of the present invention to provide a new combination table and desk which is of a durable and reliable construction.

An even further object of the present invention is to provide a new combination table and desk which is susceptible of a low cost of manufacture with regard to both materials and labor, and which accordingly is then susceptible of low prices of sale to the consuming public, thereby making such combination table and desk economically available to the buying public.

Still yet another object of the present invention is to provide a new combination table and desk which provides in the apparatuses and methods of the prior art some of the advantages thereof, while simultaneously overcoming some of the disadvantages normally associated therewith.

Still another object of the present invention is to provide a new combination table and desk for combining functions of a desk and a table.

Yet another object of the present invention is to provide a new combination table and desk which includes a base portion having a desktop disposed thereon. The desktop has a generally rectangular configuration. The desktop has a pair of storage containers. A table top portion is coupled with an upper surface of the desktop. The table top portion includes a plurality of sections hingedly coupled together at side edges thereof. The plurality of sections fold one over another to expose the desktop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
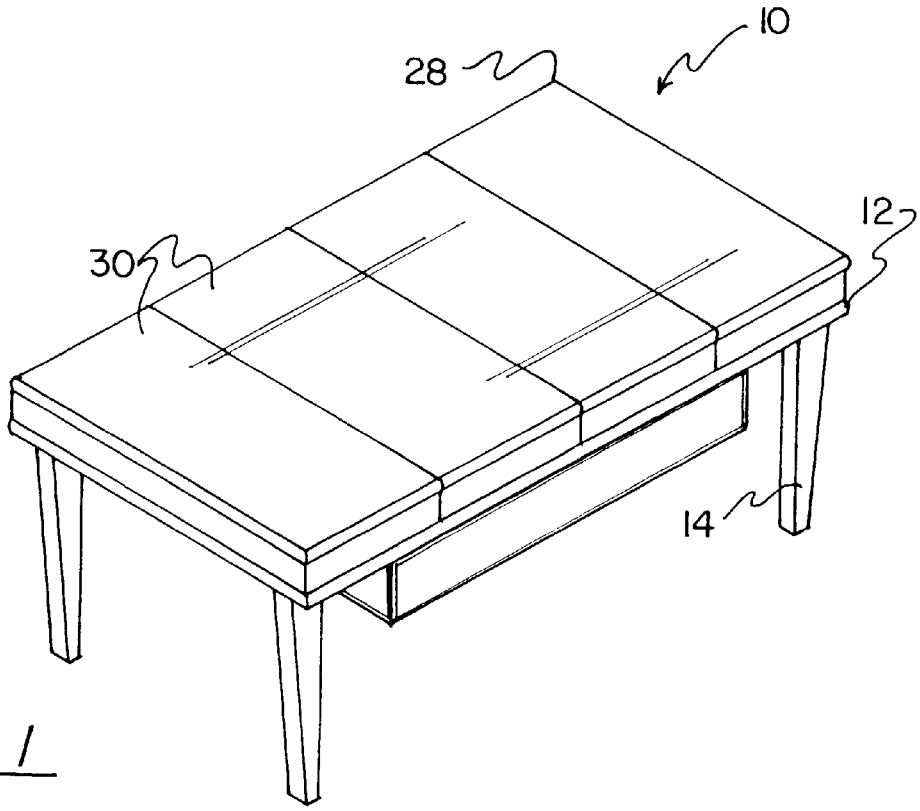
FIG. 1 is a perspective view of a new combination table and desk according to the present invention in a table orientation.
Figure 2:
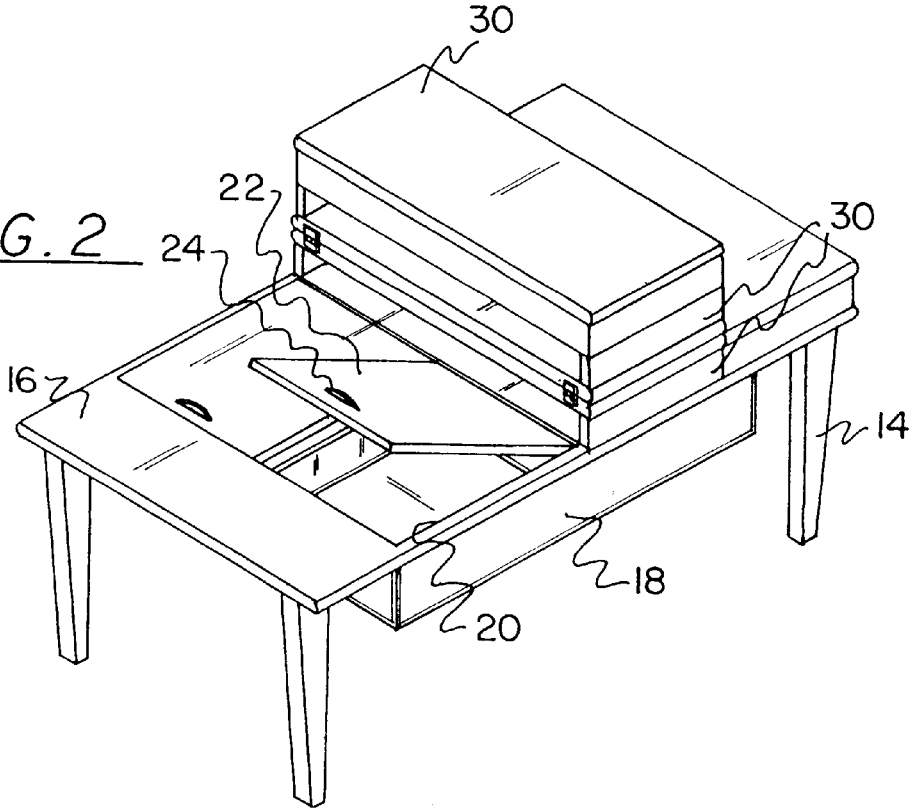
FIG. 2 is a perspective view of the present invention illustrated in a desk orientation.

With reference now to the drawings, and in particular to FIGS. 1 through 4 thereof, a new combination table and desk embodying the principles and concepts of the present invention and generally designated by the reference numeral 10 will be described.

Figure 3:
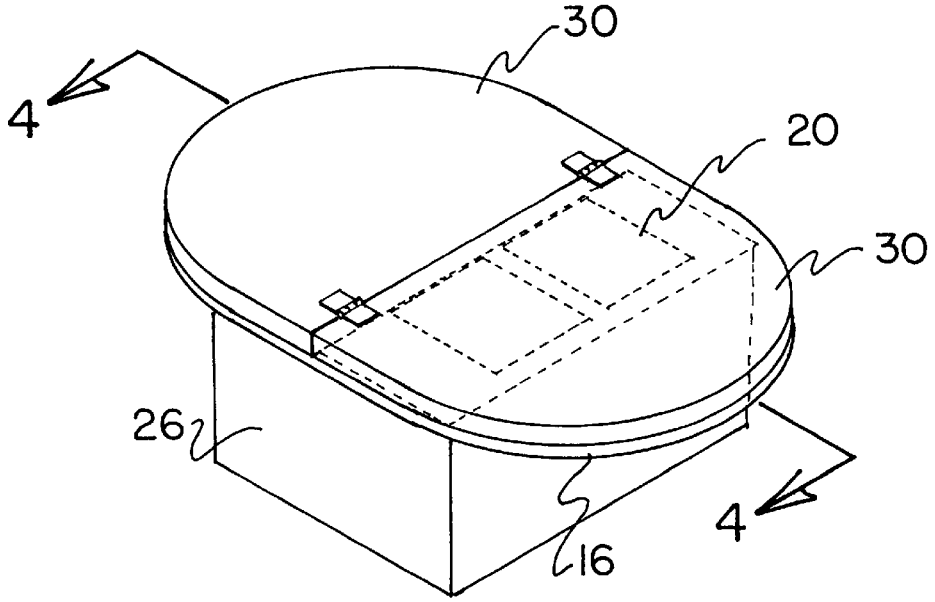
FIG. 3 is a perspective view of an alternate embodiment of the present invention.
Figure 4:
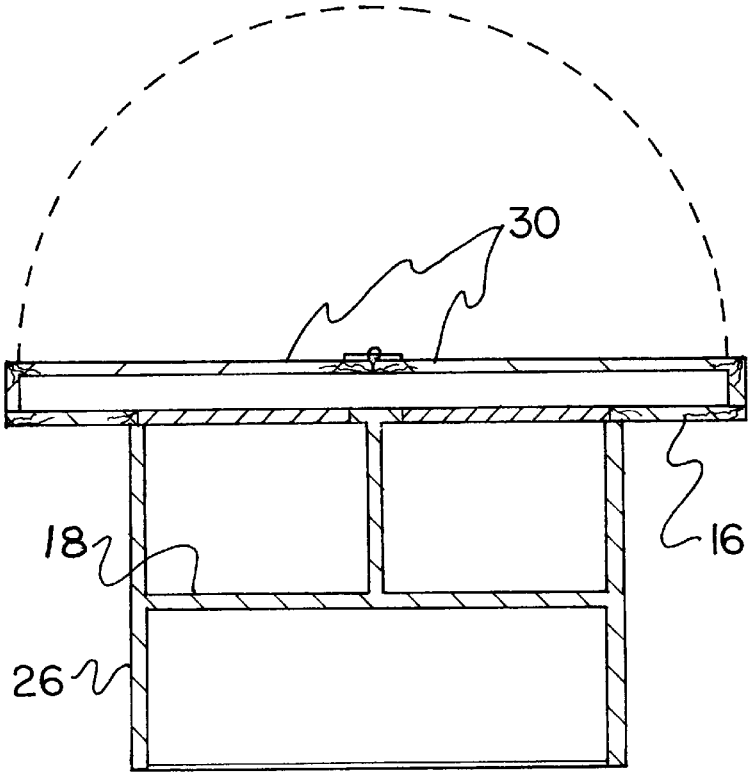
FIG. 4 is a cross-sectional view of the present invention as taken along line 4—4 of FIG. 3.

As best illustrated in FIGS. 1 through 4, the combination table and desk 10 comprises a base portion 12 including four legs 14 extending downwardly from a desktop 16. The desktop 16 has a generally rectangular configuration. The desktop 16 has a pair of storage containers 18 secured to a lower surface thereof. The desktop 16 has a pair of openings 20 therethrough leading into the storage containers 18. The pair of openings 20 each have a cover member 22 hingedly secured thereto. The cover members 22 each have a recessed handle 24. Note FIGS. 1 and 2. In an alternate embodiment, as illustrated in FIGS. 3 and 4, the four legs 14 are replaced by a solid lower frame member 26. The solid lower frame member 26 includes the storage containers 18 formed therein.

A table top unit 28 has a table top with a top surface and a bottom surface. The table top has a generally rectangular configuration. The table top unit further includes a peripheral wall extending downwardly from a peripheral edge of the bottom surface. The peripheral wall rest on an upper surface of the desk top such that a cavity is created between the upper surface of the desk top and the bottom surface of the table top. The table top unit includes a plurality of sections 30 hingedly coupled together at side edges thereof. A portion of the peripheral wall is attached to the table top at end edges thereof. A portion of the peripheral wall is attached to exterior edges of the sections such that the peripheral wall is continuous along each side of the table top unit. The plurality of sections being adapted to fold one over another to expose the desktop.

A table top unit 28 has a table top with a top surface and a bottom surface. The table top has a generally rectangular configuration. The table top unit further includes a peripheral wall extending downwardly from a peripheral edge of the bottom surface. The peripheral wall rests on an upper surface of the desktop such that a cavity is created between the upper surface of the desk top and the bottom surface of the table top. The table top unit includes a plurality of sections 30 hingedly coupled together at side edges thereof. A portion of the peripheral wall is attached to the table top at end edges thereof. A portion of the peripheral wall is attached to exterior edges of the sections such that the peripheral wall is continuous along each side of the table top unit. The plurality of sections being adapted to fold one over another to expose the desktop.

In the alternate embodiment, the desktop and table top unit have a generally oval configuratation.

In use, the present invention is a space-saving piece of furniture that would combine the functions of a desk and a table. The desktop 16 would function as the work or desktop surface and would actually be covered by the table top portion 28. The table top portion 28 would function as the standard dining or kitchen table surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination table and desk for combining functions of a desk and a table comprising, in combination:

a base portion including four legs extending downwardly from a desktop, the desktop having a generally rectangular configuration, the desktop having a pair of storage containers secured to a lower surface thereof, the desktop having a pair of openings therethrough leading into the storage containers, the pair of openings each having a cover member hingedly secured thereto, the cover members each having a recessed handle;

a table top unit having a table top with a top surface and a bottom surface, the table top having a generally rectangular configuration, the table top unit further including a peripheral wall extending downwardly from a peripheral edge of the bottom surface, the peripheral wall resting on an upper surface of the desktop such that a cavity is created between the upper surface of the desk top and the bottom surface of the table top, the table top unit including a plurality of sections hingedly coupled together at side edges thereof, a portion of the peripheral wall being attached to the table top at end edges thereof, a portion of the peripheral wall being attached to exterior edges of the sections such that the peripheral wall is continuous along each side of the table top unit, the plurality of sections being adapted to fold one over another to expose the desktop.

2. A combination table and desk for combining functions of a desk and a table comprising, in combination:

a base portion having a desktop disposed thereon, the base portion having a pair of storage containers;

a table top unit having a table top with a top surface and a bottom surface, the table top unit further including a peripheral wall extending downwardly from a peripheral edge of the bottom surface, the peripheral wall resting on an upper surface of the desktop such that a cavity is created between the upper surface of the desktop and the bottom surface of the table top, the table top unit including a plurality of sections hingedly coupled together at side edges thereof, a portion of the peripheral wall being attached to the table top at end edges thereof, a portion of the peripheral wall being attached to exterior edges of the sections such that the peripheral wall is continuous along each side of the table top unit, the plurality of sections being adapted to fold one over another to expose the desktop.

3. The combination table and desk as set forth in claim 2 wherein the storage containers are formed within the base portion.

4. The combination table and desk as set forth in claim 3 wherein the table top portion is oval shaped and divided into a pair of sections with one of the sections removably disposed over the pair of storage containers.

5. The combination table and desk as set forth in claim 2 wherein the storage containers are secured to a lower surface of the desktop with a pair of openings through the desktop thereby exposing the containers.

6. The combination table and desk as set forth in claim 5 wherein the pair of openings each have a cover member hingedly secured thereto.

* * * * *